US006146288A

United States Patent [19]

Crast et al.

[11] Patent Number: 6,146,288

[45] Date of Patent: Nov. 14, 2000

[54] UV-CURABLE CLEAR COAT FOR GOLF BALLS

[76] Inventors: Steven C. Crast; Ramon Buella Dineros, both of 2285 Rutherford Rd., Carlsbad, Calif. 92008-8815

[21] Appl. No.: 09/310,787

[22] Filed: May 12, 1999

[51] Int. Cl.[7] ..... A63B 37/04; A63B 37/06

[52] U.S. Cl. ..... 473/377; 427/512; 427/516; 427/517; 427/519; 473/377; 473/378; 522/75; 522/79; 522/80

[58] Field of Search ..... 473/377, 378; 522/75, 79, 80; 427/512, 516, 517, 519

[56] References Cited

U.S. PATENT DOCUMENTS

| | | | |
|---|---|---|---|
| 4,049,610 | 9/1977 | Bunge | 260/31.2 |
| 4,526,219 | 7/1985 | Dunnavant | 164/16 |
| 4,710,523 | 12/1987 | Lechtken | 522/14 |
| 4,785,064 | 11/1988 | Hegel . | |
| 4,871,589 | 10/1989 | Kitaoh et al. . | |
| 4,900,763 | 2/1990 | Kraushaar . | |
| 5,036,128 | 7/1991 | Durand . | |
| 5,108,653 | 4/1992 | Taylor | 252/312 |
| 5,160,536 | 11/1992 | Harris et al. . | |
| 5,179,183 | 1/1993 | Koleske | 526/301 |
| 5,218,009 | 6/1993 | Rutsch | 522/16 |
| 5,336,563 | 8/1994 | Coady et al. . | |
| 5,409,740 | 4/1995 | Brann . | |
| 5,453,449 | 9/1995 | Drueke et al. . | |
| 5,453,451 | 9/1995 | Sokol . | |
| 5,459,220 | 10/1995 | Kennedy . | |
| 5,484,870 | 1/1996 | Wu . | |
| 5,569,715 | 10/1996 | Grandhee . | |
| 5,580,323 | 12/1996 | Sullivan . | |
| 5,700,302 | 12/1997 | Stoetzel et al. . | |
| 5,770,325 | 6/1998 | Keller | 428/914 |
| 5,789,486 | 8/1998 | Maruoka | 525/123 |
| 5,827,134 | 10/1998 | Sullivan | 473/372 |
| 5,873,991 | 2/1999 | Gothe | 204/470 |
| 5,885,173 | 3/1999 | Keller | 473/385 |
| 5,977,200 | 11/1999 | Lake | 522/75 |

FOREIGN PATENT DOCUMENTS

| | | |
|---|---|---|
| 2173068 | 3/1996 | Canada . |

*Primary Examiner*—Stephen F. Gerrity
*Assistant Examiner*—Paul D. Kim
*Attorney, Agent, or Firm*—Michael A. Catania

[57] ABSTRACT

A UV-curable coating for use with golf balls and other substrates includes one or more low viscosity polyether acrylate, a functional carbodiimide resin, one or more low viscosity aliphatic urethane polyacrylate oligomer, and a photoinitiator selected from one or more of S mono-aryl ketones, trimethylbenzoyldiphenyl phosphinates, and/or phosphine oxides. In addition, a method of curing a UV-curable coating is disclosed. The method includes the steps of spraying the formulation onto the exterior of a substrate, surrounding the substrate in an inert gas environment, and irradiating the substrate with ultraviolet radiation from a doped medium pressure mercury vapor lamp.

9 Claims, 2 Drawing Sheets

UV-CURABLE CLEAR COAT FOR GOLF BALLS

CROSS REFERENCES TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of the Invention

The field of the invention is clear coats for use on the exterior of substrates. More specifically, the invention relates to coatings applied to the exterior of golf balls.

2. Description of the Related Art

Clear coats are used on the exterior surfaces of a variety of substrates. Clear coats serve to enhance the aesthetic appearance of the substrate as well as act as a barrier to protect the substrate from weathering, mechanical agitation and the like. One such substrate in which clear coats are of particular importance is a golf ball.

A golf ball generally comprises a one-piece construction or it may include several layers including an outer cover surrounding the core. Typically, one or more layers of paint and/or clear coat are applied to the outer surface of the golf ball. For example, in one typical design, the outer surface of the golf ball is first painted with at least one clear or pigmented basecoat primer along with at least one application of a clear top coat. The basecoat and/or primer and clear top coat are applied to the golf ball to enhance the aesthetic appearance of the ball as well as mask or cover surface blemishes that may have resulted from the manufacturing process. The clear top coat is particularly important, in that the coat protects any markings, trademarks, logos, or the like that may be placed on the cover of the ball.

One typical top coat for golf balls utilizes a solvent borne two-component polyurethane that is applied to the exterior of a golf ball. Unfortunately, such top coat formulations require the use of a solvent that is a significant source of volatile organic compounds (VOC's). The presence of VOC's within the solvent component poses numerous environmental and health problems. Consequently, there is thus a need to develop a top coat that is substantially free of volatile compounds.

Attempts have been made to develop coatings for use with substrates other than golf balls that are substantially if not entirely solvent free. One particular area of interest is ultra violet (UV) curable top or clear coats. These top coats utilize radiation in the ultraviolet spectrum to cure a top coat on the surface of a golf ball without the use of solvents thereby elminating or substantially reducing the presence of VOC's. The UV radiation is used to trigger a polymerization reaction and cure the top coat.

U.S. Pat. No. 5,453,451 ("the '451 patent") to Sokol discloses a finishing composition which is curable by UV radiation that is substantially free of solvents. The finishing composition of the '451 patent includes a polymerizable compound which is an acrylate and a photoinitiator. The polymerizable compound is from about 80 to about 99.5 percent of the total weight of the composition. The photoinitiator is from about 0.5 percent to about 15 percent of the total weight of the composition. Instead of solvents, a low molecular weight mono or di-acrylate monomer is added to the composition of the 451 patent to control the viscosity for spraying it onto a substrate. Unfortunately, the presence of low molecular weight dilutents as recited in the '451 patent is disadvantageous in that the low molecular weight dilutents increase the toxicity of the composition.

In addition, previous UV-curable coating formulations have generally been at a disadvantage for use as a coating for golf balls to the more traditional two-component polyurethane top coats. For example, previous UV-curable coatings have had deficiencies in abrasion resistance, which is a measure of the ability of the coating to retain and maintain its glossiness in response to weathering and use. These coatings have also had a poor resistance to dirt-pick-up, a related measure of the abrasion resistance of a coating.

Moreover, such coatings have generally poor adhesion qualities in primer/basecoat applications in addition to "direct-to-cover" methods. Adhesion as used herein is the ease to which the top coat bonds to the cover and is required to protect any trademark, lettering, logo, or the like that is on the golf ball surface. In addition, previous UV-curable coatings had a tendency to discolor more rapidly and to a greater extent than the two-component polyurethane coatings. Moreover, an aesthetically unappealing yellowing of the coating is often present in current UV formulations.

These deficiencies have been traced to a variety of factors inherent in traditional UV-curable compositions. For example, UV-curable compositions are preferably cured in air. The oxygen present in the air will interfere with the transmission of UV energy to the reactants. The oxygen will also be transformed into ozone upon absorption of sufficient UV energy. Additionally, the oxygen reacts with the reactants, especially the photoiniatior, thereby necessitating greater amounts of the reactants to form the composition.

A related factor is the need for a higher intensity UV lamp, or operating an UV lamp at a higher intensity to compensate for the oxygen or reactant deficiencies. The higher intensity UV lamp will add to the yellowing of the coating as well as consuming a greater amount of energy. Another factor that adds to yellowing is the choice of photoiniators for the composition. Yellowing may also be caused by the use of particular low molecular weight monomers. These low molecular weight monomers also have toxicity problems and cause brittleness in the UV curable composition. Usually, higher molecular weight oligomers must be added to the composition to compensate for this brittleness.

Consequently, there remains a need for a UV-curable coating that retains the beneficial aspects of a traditional two-component polyurethane formulation without the negative side-effects that are present in current UV-curable formulations. Moreover, there remains a need for a method of curing the UV-curable coating without forming the characteristic yellowing that is prevalent in most UV-curable compositions. Such a coating would be able to be applied using traditional types of spray equipment and contain little or no VOC's.

BRIEF SUMMARY OF THE INVENTION

The present invention provides a solution to the problems of the prior art UV curable coatings. The present invention is able to overcome these problems by providing a novel UV-curable composition for use as a top coat for a golf ball.

In a first aspect of the present invention, a golf ball includes an exterior surface surrounded by a UV-curable top coat. The UV-curable top coat includes one or more low viscosity modified polyether acrylates, a functional carbodiimide resin, one or more low viscosity aliphatic urethane polyacrylate oligomers, and a photoinitiator component including one or more photoinitiators selected from the group consisting of mono-aryl ketones, trimethylbenzoyldiphenyl phosphinates, and other phosphine oxides.

In a second aspect of the invention, a UV-curable coating comprises one or more low viscosity modified polyether acrylates, a functional carbodiimide resin, one or more low viscosity aliphatic urethane polyacrylate oligomers, and a photoinitiator component including one or more photoinitiators selected from the group consisting of mono-aryl ketones, trimethylbenzoyldiphenyl phosphinates, and other phosphine oxides.

In a third, separate aspect of the invention, a method of curing a UV-curable coating is provided. The method includes the applying a UV-curable top coat onto a substrate, surrounding the substrate with an inert gas, and irradiating the substrate containing the UV-curable coating with radiation from a doped medium pressure mercury vapor lamp. The coated substrate is irradiated for a period of time to achieve an energy dose of around 750 mJ/cm$^2$ to about 2250 mJ/cm$^2$ at the surface of the substrate. A preferred energy dose is 750 mJ/cm$^2$ to about 1250 mJ/cm$^2$ at the surface of the substrate in an inert atmosphere.

It is a primary object of the present invention to provide a UV-curable coating and method of application that is capable of producing a coating with performance similar to or better than traditional two-component solvent based coatings.

It is an additional object of the present invention to provide a UV-curable clear coating for a golf ball that has superior abrasion resistance qualities as well as good adhesion characteristics.

It is an additional object of the present invention to provide a UV curable clear coating for a golf ball that may be utilized without a primer or basecoat.

Having briefly described the present invention, the above and further objects, features and advantages thereof will be recognized by those skilled in the pertinent art from the following detailed description of the invention when taken in conjunction with the accompanying drawings.

BRIEF DESCRIPTION OF SEVERAL VIEWS OF THE DRAWINGS

There is illustrated in FIG. 1 a cross-sectional view of a golf ball with the UV-curable coating of the present invention thereon.

There is illustrated in FIG. 1A an enlarged view of circle A of FIG. 1.

Figure 2:
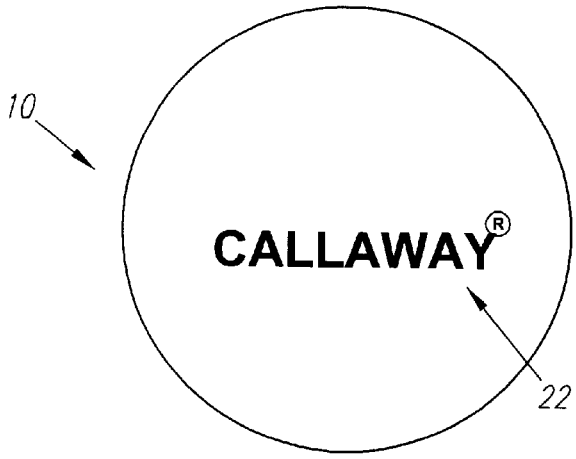

There is illustrated in FIG. 2 a perspective view of a golf ball with the UV-curable coating of the present invention thereon.

Figure 3:
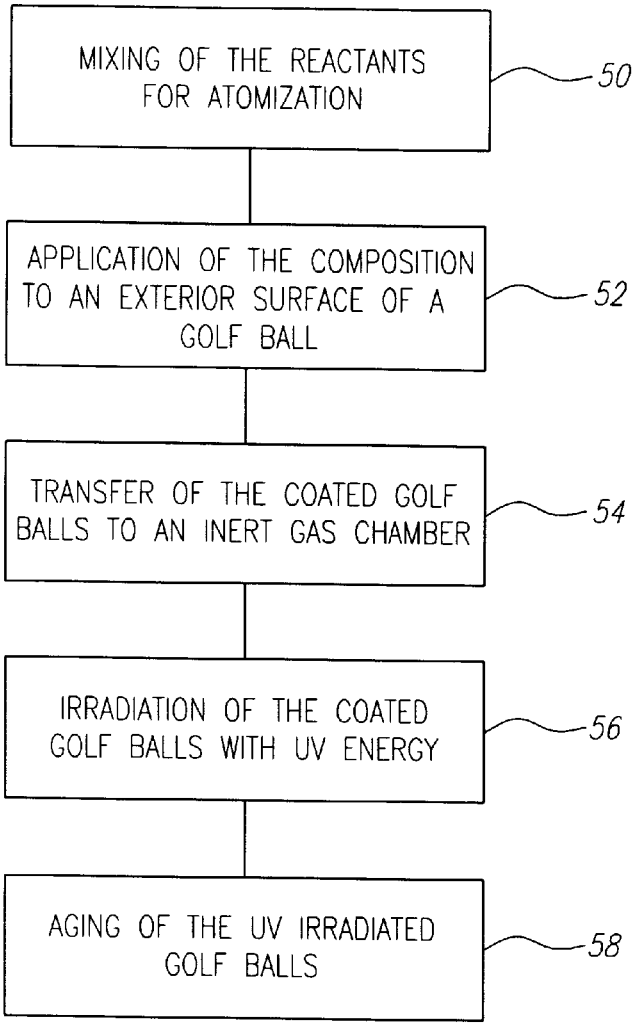

There is illustrated in FIG. 3 a flow chart of the method for producing a golf ball with the UV-curable coating of the present invention thereon.

DETAILED DESCRIPTION OF THE INVENTION

Although the UV-curable coating formulation of the present invention is suitable for use on a range of different substrates such as wood, plastic, rubber, metal and the like, the following description will focus on the use of the UV-curable coating on a golf ball. This description is for exemplary purposes only, and is not intended to limit the scope of the invention described in the attached claims.

Figure 1:
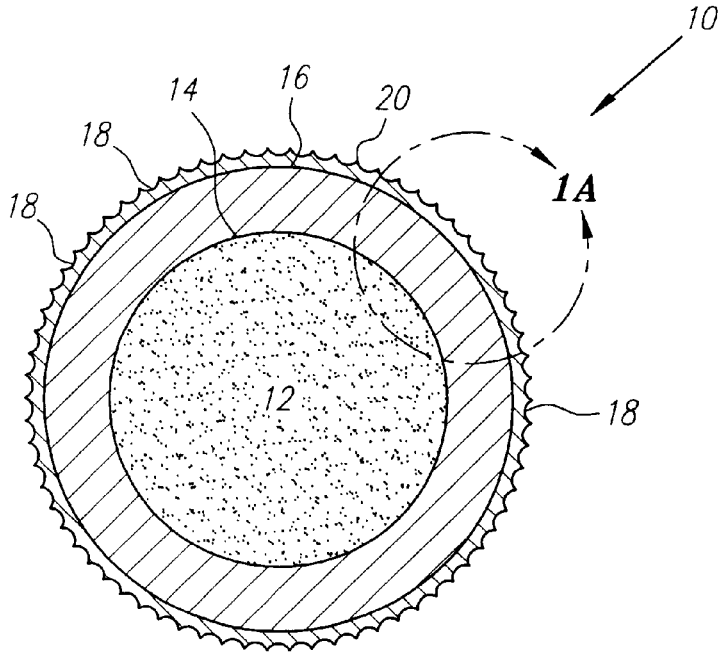
Figure 1A:
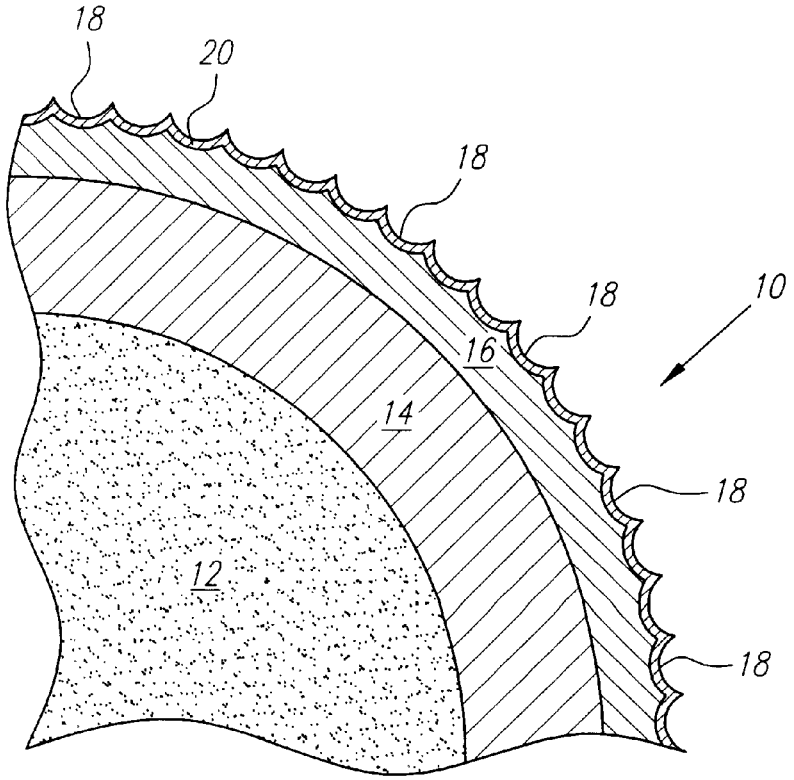

As shown in FIGS. 1 and 1A, a golf ball 10 is composed of a core 12, a boundary layer 14, a cover 16 having a plurality of dimples 18 and a polyurethane top coating 20 of the present invention which is formed from an UV-curable coating of the present invention. Alternatively, a golf ball 10 may only have a core 12, a cover 16 with a plurality of dimples 18 thereon and a polyurethane top coating 20. Further, the golf ball 10 may be only one piece wherein the core 12 represents the entirety of the golf ball 10, and the plurality of dimples are on the core 12. The UV-curable coating is applied over the exterior surface of an unfinished golf ball 10, and then cured as described below. The thickness of the polyurethane top coating 20 is miniscule compared to the cover 16 or the boundary layer 14. The thickness of the polyurethane top coating 20 may preferably range from approximately 0.1 mils to 1.0 mils, and more preferably the thickness is 0.5 mils. The polyurethane top coating 20 should have a minimal effect on the depth and volume of each of the plurality of dimples 18.

The cover 16 of the golf ball 10 may be made of any number of materials such as ionomeric, thermoplastic, elastomeric, urethane, balata (natural or synthetic), polybutadiene or any combination of the above. An optional primer or basecoat may be applied to the exterior surface of the cover 16 of the golf ball 10 prior to application of the UV-curable coating.

As shown in FIG. 2, the polyurethane top coating 20 will protect indicia and logos 22 that are printed on the cover 16. The polyurethane top coating 20 provides such protection for the useful life of the golf ball 10.

The UV-curable coating formulation of the present invention generally includes four principal components. Additional additives, such as flow additives, mar/slip additives, adhesion promoters, thickeners, and gloss reducers may also be incorporated into the formulation. The four principal components of the UV-curable coating include: (1) one or more low viscosity modified polyether acrylates; (2) a functional carbodiimide resin; (3) one or more low viscosity aliphatic urethane polyacrylate oligomers; and (4) a photoinitiator. It should be noted that, unlike traditional UV-coating formulations, the UV-curable coating formulation of the present invention contemplates no low molecular weight functional monomer dilutents.

The polyether acrylate component will consist of between 35 to 90 weight percentage of the total composition weight of the UV-curable coating. The polyether acrylate component has a low viscosity, preferably in the range of about 50 to about 250 centipoise. The main function of the low molecular weight polyether acrylate component is to lower the viscosity of the UV-curable coating. A preferred polyether acrylate is an oligoether acrylate. Examples of commercially available oligoether acrylates include LAROMER LR 8967, LAROMER PO 43F, and LAROMER 8863, which are all sold commercially by BASF.

One or more aliphatic urethane polyacrylate oligomers are also included as a component in the UV-curable coating. The aliphatic urethane polyacrylate oligomer component may be a blend of differing oligomers or the same oligomer. A urethane acrylate oligomer is produced by the poly-addition product of a polyol with a diisocynate. The urethane product is further reacted with a hydroxyalkyl acrylate to produce the final urethane polyacrylate oligomer. A preferred product is produced by first reacting neopentyl glycol with isophorone diisocynate, and then reacting this product with hydroxy ethyl acrylate. The molecular weight distribution of the final product may be controlled by the rate of addition of the acrylate and by physical means such as heat.

Preferably, the aliphatic urethane polyacrylate oligomer component will be between about 5.0 weight percent to about 60.0 weight percent of the total UV-curable coating. The aliphatic urethane polyacrylate oligomer component has a relatively low viscosity, preferably in the range of about 20,000 to about 40,000 centipoise at 77 degrees Fahrenheit. The aliphatic urethane polyacrylate oligomer component provides the abrasion resistance, the resiliency and the high gloss of the polyurethane coating 20. As illustrative and non-limiting examples, the aliphatic urethane polyacrylate oligomer component may be one or both of BOMAR BR 5825 and BOMAR BR 5824, sold commercially by Bomar Specialties, Winsted, Conn.

The functional carbodiimide resin utilized in the UV-curable coating of the present invention is a carbodiimide that may be used for curing, crosslinking and/or binding to non-reacted portions of the UV-curable coating. The functional carbodiimide also assists in binding the components of the polyurethane coating 20 together. The functional carbodiimide also promotes adhesion of the UV-curable coating to exterior surface of the cover 16, especially is the cover 16 is composed of an elastomeric material. Preferably, the carbodiimide resin comprises on a weight basis, based on the total composition weight, between about 1.00 percent to about 3.00 percent of the total UV-curable coating. Examples of carbodiimide resins that can be used include UCARLINK XL29-SE, sold commercially by Union Carbide.

The photoinitiator component of the UV-curable coating of the present invention is preferably a combination of one or more photoinitiators selected from the group consisting of mono-aryl ketones, trimethylbenzoyldiphenyl phosphinates, and other phosphine oxides. Preferably, the photoinitiator component is between about 0.25 weight percent and about 4.00 weight percent of the total UV-curable coating. The photoinitiator component advantageously has a peak absorbance in the range of about 260 nm to about 390 nm. This absorbance range will eliminate or at least lessen the yellowing of the polyurethane top coating 20. The photoiniator component is the driving force of the reaction to form the polyurethane top coating 20. Upon absorption of UV energy, the photoiniator component is transformed into a free radical component that reacts with and polymerizes the aliphatic urethane polyacrylate oligomer component and the polyether acrylate component to form the polyurethane top coating 20. The functional carbodiimide is also polymerized into the UV-curable coating. As contemplated herein, the photoinitiators may include: VICURE 55, available commercially from Akzo Nobel; GENOCURE MBF, available from Rahn, Inc.; 2,2'-Diethoxyacetophenone; LUCIRIN TPO or LUCIRIN TPO-L, available from BASF; or IGRACURE 819, available from Ciba.

A flow additive may also be used to assist in the adhesion of the UV-curable coating to the exterior of the golf ball. The flow additives are preferably between about 0.25 weight percent and 0.50 weight percent of the total UV-curable coating.

Table 1 shown below lists on a weight basis, based on the total composition weight, the range of the various materials used in the UV-curable coating.

TABLE 1

UV-Curable Clear Coat Formulation

| MATERIAL | PARTS BY WEIGHT |
|---|---|
| Polyether acrylate | 35.0–90.0 |
| Aliphatic polyurethane Acrylate | 5.0–60.0 |
| Photoinitiator | 0.25–4.00 |
| Carbodiimide resin | 1.00–3.00 |
| Flow Additives | 0.25–0.50 |

The unique and novel method of producing the polyurethane top coat of the present invention for a golf ball 10 is set forth below in reference to the flow chart illustrated in FIG. 3. The four principal reactants and any additional reactants such as flow additives, are maintained in separate, opaque containers. The specific amounts, based on weight, of each reactant are mixed together to form the UV-curable coating, as indicated at block 50, in a mixing container that may be in flow communication with application apparatus. The mixing container should be opaque to prevent the possibility of the reactants reacting prior to application to a golf ball 10. The mixing ensures that the reactants are evenly distributed throughout the application composition. Thus, each specific quantity of the UV-curable coating should contain the desired amounts of the aliphatic urethane polyacrylate oligomer, the polyether acrylate, the functional carbodiimide, the photoiniator, and any optional flow additive.

The preferred method of applying the UV-curable coating to a golf ball 10 is with the use of heated spray equipment. The heated spray equipment offers superior atomization while also minimizing the material lost to over-spray. Commercially available heated, turbo spray equipment is available from CAN-AM Engineering, Livonia, Mich. Additional methods of spray application include electrostatic and high volume-low pressure (HVLP) devices. In addition, conventional spray guns or other atomizing devices operating at or above about 60 psi may also be used. The UV-curable coating is applied in an atomized form to the exterior surface, usually the cover 16, of an unfinished golf ball 10, as shown at block 52. As mentioned previously, the golf ball 10 may be a single-component golf ball 10, a dual-component golf ball 10, or a golf ball with one or more boundary layers 14 between the core 12 and cover 16. The entire exterior surface of the unfinished golf ball 10 is coated with the UV-curable coating to a preselected thickness, preferably 0.5 mils.

After application of the UV-curable coating, the coated golf ball 10 is then preferably transferred to an inert gas environment, as shown at block 54, for irradiation with UV energy. Alternatively, the application of the UV-curable coating may be conducted in an inert gas environment. The inert gas may be selected from the group consisting of Argon, Helium or Nitrogen. The preferred environment is a nitrogen gas environment. The inert gas environment provides many benefits over a conventional air environment. The inert gas will not react with the reactants of the UV-curable coating, especially the photoiniator. This allows for the use of lower amounts of the reactants in the UV-curable coating of the present invention since there is no need to compensate for reactants that may have reacted with oxygen. Further, the inert gas environment allows for a lower intensity of an UV lamp since the environment is free of oxygen molecules that may interfere with the transmission of UV energy to the UV-curable coating, and may form ozone.

While the coated golf ball 10 is in the inert environment, the UV-curable coated golf ball is subjected to irradiation with UV energy from one or more UV sources, as indicated at block 56. A doped medium pressure mercury vapor lamp may be used as the UV radiation source, or alternatively other UV sources may be used such as an excimer UV lamp. The doped medium pressure mercury vapor lamp contains mercury gas and additional metals or metal halide materials as dopants. Gallium, iron, or a gallium-argon material are some examples of dopants. The doping of the mercury vapor lamp serves to adjust the peak power output of the lamp towards the visible region of the spectrum, i.e., increasing the wavelength of the light.

Most preferably, the power output of the lamp is within the range of about 23.25 J/sec $cm^2$ (150 Watts/$in^2$) to about 31.00 J/sec $cm^2$ (200 Watts/$in^2$). The range of power outputs utilized in the method of the present invention yields golf balls with a brighter and whiter appearance since the lower intensity prevents yellowing of the polyurethane top coating 20.

The amount of time that the golf ball 10 is exposed to the ultraviolet radiation is determined based on the power output of the lamp and level of photoinitiator. However, it has been found that it is preferable that the golf balls 10 be exposed for a sufficient amount of time such that an energy dose in the range of about 750 mJ/$cm^2$ to about 2250 mJ/$cm^2$ is delivered to the UV-curable coating on the exterior surface of the golf ball 10.

After UV-curing, the golf balls 10 are ready for handling. However, to achieve full curing properties, the WV-cured golf balls 10 should be aged, as shown at block 58, for about 48 hours after the initial cure. After aging, the golf ball 10 with a polyurethane top coating 20 of the present invention is ready for play. The UV-curable coating contains no solvents. In addition, the UV-curable coating is free of low molecular weight functional monomer dilutents that are toxic. The WV-curable coating may be applied to either a primer/basecoat or directly to the exterior surface of a golf ball 10. The improved polyurethane top coating 20 exhibits superior adhesion characteristics as well as abrasion resistance. Moreover, the characteristic discoloration of traditional UV-curable top coats is avoided by the UV-curable coating of the present invention.

The following examples are set forth to demonstrate the efficacy of the present invention, and such examples should not be used to limit the claims set forth below.

EXAMPLES

Example #1

| Ingredient | Parts by weight | Manufacturer |
|---|---|---|
| Oligoether acrylate: Laromer LR 8967 | 50.00 | BASF |
| Low viscosity urethane acrylate oligomer:BR-5824 | 44.00 | Bomar Specialties |
| Mono-aryl ketone photoinitiator: Vicure 55 | 1.00 | Akzo Nobel |
| Carbodiimide resin: Ucarlink XL-29SE | 3.00 | Union Carbide |
| Additives: | | |
| Surface flow: Silwet L-77 | 0.50 | Witco |
| Mar & slip: DC-193 | 0.50 | Dow-Corning |
| Adhesion promoter: Silquest A-187 | 1.00 | Witco |
| Total | 100.00 | |

-continued

Example #2

| Ingredient | Parts by weight | Manufacturer |
|---|---|---|
| Oligoether acrylate: Laromer LR 8967 | 50.00 | BASF |
| Low viscosity urethane acrylate oligomer:BR-5825 | 44.00 | Bomar Specialties |
| Mono-aryl ketone photoinitiator: Vicure 55 | 1.00 | Akzo Nobel |
| Carbodiimide resin: Ucarlink XL-29SE | 3.00 | Union Carbide |
| Additives: | | |
| Surface flow: Silwet L-77 | 0.50 | Witco |
| Mar & slip: DC-193 | 0.50 | Dow-Corning |
| Adhesion promoter: Silquest A-187 | 1.00 | Witco |
| Total | 100.00 | |

Example #3

| Ingredient | Parts by weight | Manufacturer |
|---|---|---|
| Oligoether acrylate: Laromer LR 8967 | 50.00 | BASF |
| Low viscosity urethane acrylate oligomer:BR-5825 | 44.00 | Bomar Specialties |
| Mono-aryl ketone photoinitiator: Genocure*MBF | 1.00 | Rahn |
| Carbodiimide resin: Ucarlink XL-29SE | 3.00 | Union Carbide |
| Additives: | | |
| Surface flow: Silwet L-77 | 0.50 | Witco |
| Mar & slip: DC-193 | 0.50 | Dow-Corning |
| Adhesion promoter: Silquest A-187 | 1.00 | Witco |
| Total | 100.00 | |

Example #4

| Ingredient | Parts by weight | Manufacturer |
|---|---|---|
| Oligoether acrylate: Laromer LR 8945 | 50.00 | BASF |
| Low viscosity urethane acrylate oligomer:BR-5825 | 44.00 | Bomar Specialties |
| Mono-aryl ketone photoinitiator: Genocure*MBF | 1.00 | Rahn |
| Carbodiimide resin: Ucarlink XL-29SE | 3.00 | Union Carbide |
| Additives: | | |
| Surface flow: Silwet L-77 | 0.50 | Witco |
| Mar & slip: DC-193 | 0.50 | Dow-Corning |
| Adhesion promoter: Silquest A-187 | 1.00 | Witco |
| Total | 100.00 | |

Example #5

| Ingredient | Parts by weight | Manufacturer |
|---|---|---|
| Oligoether acrylate: Laromer LR 8945 | 45.00 | BASF |
| Low viscosity urethane acrylate oligomer:BR-5825 | 49.00 | Bomar Specialties |
| Mono-aryl ketone photoinitiator: Genocure*MBF | 1.00 | Rahn |
| Carbodiimide resin: Ucarlink XL-29SE | 3.00 | Union Carbide |
| Additives: | | |
| Surface flow: Silwet L-77 | 0.50 | Witco |
| Mar& slip: DC-193 | 0.50 | Dow-Corning |
| Adhesion promoter: Silquest A-187 | 1.00 | Witco |
| Total | 100.00 | |

Golf balls having polyurethane top coatings formed from UV-curable coatings composed of the reactants set forth in Examples 1–5 were compared to five other golf balls having different coatings. The results of this comparison are set forth in Table Two. The air cannon test was performed by firing golf balls at 150 feet per second against a rigid wall. The golf balls were subjected to microscopic inspection after 100 firings. The observations that were subjectively measured were: 1) adhesion of the paint to the golf ball; 2) texture (orange peel appearance) of the paint; 3) chipping of the paint from the golf ball; 4) abrasion resistance (gloss retention) of the golf ball; and 5) cracking of the paint. The rating scale for the air cannon test was as follows: 1=failure; 2=poor; 3=fair; 4=good and 5=excellent. The color results were obtained using a Hunter Ultrascan XE color computer, at a 2 degree observer and a Daylight setting of 65. The "L" value is a measurement of the brightness. 89 or above is desired for the L value to have a sufficient high gloss for the golf ball. The "a" value is a measurement of the redness or greenness of the golf ball. The more negative the value, the redder the golf ball while the more positive the value, the greener the golf ball. Negative 2 or lower is desired for the "a" value. The "b" value is a measurement of the blueness or yellowness of the golf ball. The more negative the value, the more blue the golf ball while the more positive the value, the more yellow the golf ball. Negative 10 or lower is desired for the "b" value.

TABLE 2

| UV Paint Identification | Cover material | Air Cannon (observations after 100 firings) Adhesion | Orange Peel | Chipping | Abrasion Resistance | Cracking | Color computer vaines (avg.)* L | a | b |
|---|---|---|---|---|---|---|---|---|---|
| Sutherland Golf Sabre Ball | Ionomeric | 4 | 5 | 4 | 4 | 2 | 91.40 | −3.20 | −5.50 |
| AVTech (Lord UV Paint) | Ionomeric | 4 | 5 | 3 | 5 | 2 | 91.40 | −3.20 | −5.90 |
| UV Coatings Ltd. | Ionomeric | 1 | 5 | 2 | 4 | 4 | 89.00 | −2.50 | −9.00 |
| Lily Industries | Polyurethane | 4 | 4 | 4 | 4 | 1 | 92.00 | −2.20 | −14.20 |
| Qure Tech | Polyurethane | 3 | 5 | 4 | 4 | 1 | 89.30 | −2.90 | −9.50 |
| Examples 1–5 | Polyurethane | 5 | 5 | 4 | 4 | 4 | 89.30 | −2.50 | −10.30 |

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim as our invention the following:

1. A golf ball comprising a polyurethane top coat covering substantially the entire golf ball the polyurethane top coat formed from a UV-curable coating comprising at least one low viscosity polyether acrylate, a functional carbodiimide resin, at least one low viscosity urethane acrylate oligomer, and a photoinitiator.

2. The golf ball according to claim 1 wherein the low viscosity modified polyether acrylate of the top coat has a viscosity within the range of about 50 centipoise to about 250 centipoise.

3. The golf ball according to claim 1 wherein the low viscosity urethane acrylate oligomer of the top coat has a viscosity within the range of about 20,000 centipoise to about 40,000 centipoise.

4. The golf ball according to claim 1 wherein the photoinitiator of the top coat has a peak absorbance in the range of about 260 nm to about 390 nm.

5. The golf ball according to claim 1 wherein the photoinitiator of the top coat is selected from the group consisting of a mono-aryl ketone, trimethylbenzoyldiphenyl phosphinates, phosphine oxides, and any combination thereof.

6. A golf ball comprising a polyurethane top coat covering substantially the entire golf ball, the polyurethane top coat formed from a UV-curable coating comprising at least one low viscosity polyether acrylate in an amount ranging from 35 to 90 parts per weight of the UV-curable coating, a functional carbodiimide resin in an amount ranging from 1 to 3 parts per weight of the UV-curable coating, at least one low viscosity urethane acrylate oligomer in an amount ranging from 5 to 60 parts per weight of the UV-curable coating, and a photoinitiator in an amount ranging from 0.25 to 4.00 parts per weight of the UV-curable coating.

7. The golf ball according to claim 6 wherein the at least one low viscosity polyether acrylate in an amount of approximately 50 parts per weight of the UV-curable coating, a functional carbodiimide resin in an amount of approximately 3 parts per weight of the UV-curable coating, at least one low viscosity urethane acrylate oligomer in an amount of approximately 44 parts per weight of the UV-curable coating, and a photoinitiator in an amount of approximately 1 part per weight of the UV-curable coating.

8. The golf ball according to claim 6 wherein the at least one low viscosity polyether acrylate in an amount of approximately 45 parts per weight of the UV-curable coating, a functional carbodiimide resin in an amount of approximately 3 parts per weight of the UV-curable coating, at least one low viscosity urethane acrylate oligomer in an amount of approximately 49 parts per weight of the UV-curable coating, and a photoinitiator in an amount of approximately 1 part per weight of the UV-curable coating.

9. The golf ball according to claim 6 wherein the polyurethane top coat has a thickness in the range of 0.1 mils to 1.0 mils.

* * * * *